US006257539B1

(12) United States Patent
Pelaez

(10) Patent No.: US 6,257,539 B1
(45) **Date of Patent: *Jul. 10, 2001**

(54) MARKER PEN HOLDER

(76) Inventor: Pedro R. Pelaez, 11960 NW. 87th Ave., Miami, FL (US) 33016

( * ) Notice: Subject to any disclaimer, the term of this patent is extended or adjusted under 35 U.S.C. 154(b) by 0 days.

This patent is subject to a terminal disclaimer.

(21) Appl. No.: 09/677,466

(22) Filed: Sep. 29, 2000

Related U.S. Application Data

(63) Continuation of application No. 09/325,946, filed on Jun. 4, 1999, now Pat. No. 6,186,461.

(51) Int. Cl.[7] ..... A47F 5/00
(52) U.S. Cl. ..... 248/314; 206/214; 224/219
(58) Field of Search ..... 248/314, 311.3, 248/511, 519, 539, 512; 15/435, 444; 211/69.1; 206/214; 401/259; D19/81; 224/219

(56) References Cited

U.S. PATENT DOCUMENTS 3,315,644 * 4/1967 Riepe ..... 401/259
5,163,549 * 11/1992 Hayduchok ..... 206/214
5,332,090 * 7/1994 Tucker ..... 248/314 X
5,372,252 * 12/1994 Alexander ..... 206/210
5,628,400 * 5/1997 Feder ..... 206/379
5,823,363 * 10/1998 Cassel ..... 206/366

* cited by examiner

*Primary Examiner*—Ramon O. Ramirez
(74) *Attorney, Agent, or Firm*—J. Sanchelima

(57) ABSTRACT

A holder for marker pens that keep the latter readily available for use while providing a relatively sealed compartment that prevents or minimize the circulation of air around the tip of the pen. The housing has slanted walls that provide structural stability to the holder when it holds one or more pens. An opening in the housing includes upper and lower cavities with a slanted portion inbetween acting as a seal for the end of the tubular housing of a pen. As step in the lower cavity further reduces its diameter ensuring the further isolation of the pen's tip thus protecting from the frying action of circulating air. Portable embodiments for use with a user's belt permit ready access to pens for an ambulatory user. One of these embodiments includes a removable pen holder member.

2 Claims, 2 Drawing Sheets

MARKER PEN HOLDER

This is a continuation of application Ser. No. 09/325,946 filed on Jun. 4, 1999, now U.S. Pat. No. 6,186,461.

BACKGROUND OF THE INVENTION

1. Field of the Invention

The present invention relates to a marker pen holder.

2. Description of the Related Art

Many designs for a pen holder exist nowadays. However, none of them disclose the novel feature of the present invention. The present invention discloses a marker pen holder that has such a design that substitutes the covering cap for the marking tip while holding in place the pen marker. This is a very convenient feature for users of pens, such as markers, since it avoids the need to take off and replace the cap constantly.

SUMMARY OF THE INVENTION

It is one of the main objects of the present invention to provide a marker pen holder that has such a design that cooperatively and snugly houses the marking/writing tip of a pen marker.

It is another object of this invention to provide a marker pen holder that holds vertically a marker pen on a flat surface.

It is another object of this invention to eliminate using the cap, so that it does not have to be removed and replaced constantly.

It is another object of this invention to provide a marker pen holder that holds a marker pen substantially vertically while being carried on a belt.

It is still another object of the present invention to provide a holder that prevents the tip from drying up.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
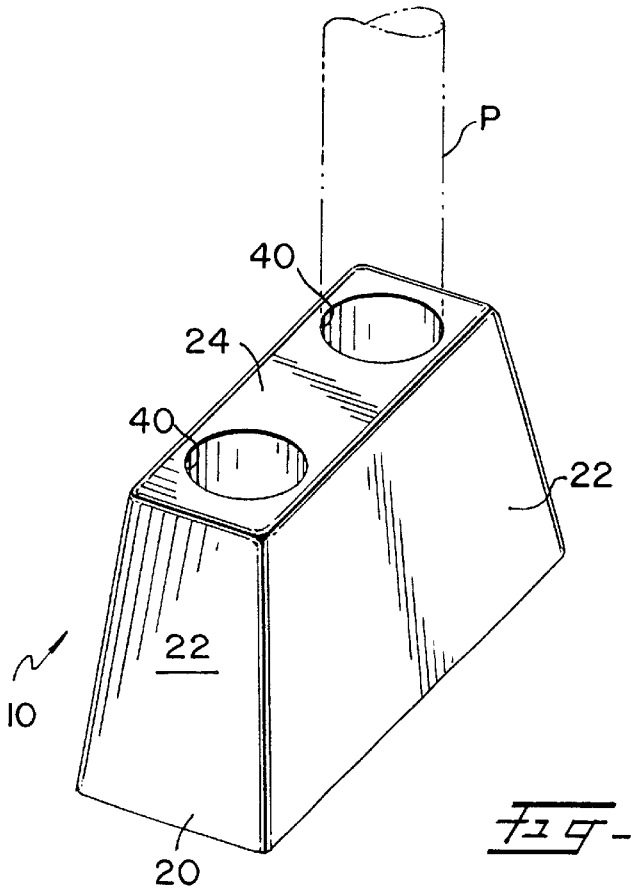
FIG. 1 is an isometric view of a marker pen stationary holder with a marker pen in phantom.

Referring now to the drawings, where the present invention is generally referred to with numeral 10, it can be observed that it basically includes body 20 with openings 40 disposed adjacent to each other. Pen holder 10 can have one or more openings similar to openings 40. The preferred embodiment shown has two openings 40.

As illustrated in FIGS. 1, marker pen holder 10 has a truncated configuration defined by slanted lateral walls 22, upper wall 24 and bottom wall 26. This is intended to provide stability to the combination of holder 10 and pen P.

Figure 2:
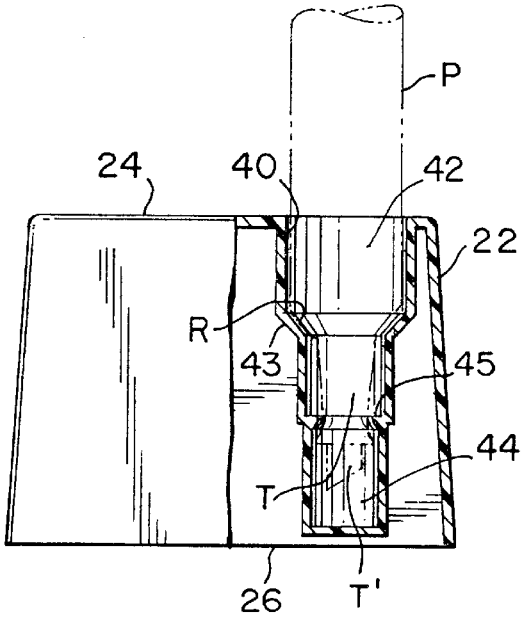
FIG. 2 is a partial cross-sectional view of the present invention.

Openings 40 start on upper wall 24 and extend perpendicularly inwardly. As best seen in FIG. 2, openings 40 include upper cavity 42 and lower cavity 44. Most conventional marker pens have a tubular shape with a rounded termination R next to the tip assembly T. Termination R rests on slanted portion 43 of cavity 42 substantially conforming to it. Upper cavity 42 has slanted portion 43 that connects cavity 42 with cavity 44. Cavity 44 includes inner step 45 that further reduces the diameter of cavity 44 providing a second resting area for the end of tip assembly T of pen P which is typically larger than the tip member T' of pen P.

In this manner, holder 10 provides two seating areas that substantially conform to the outer tubular dimensions of pen P to prevent circulation of air tending to dry tip member T' while at the same time pen P is readily available for use.

Figure 3:
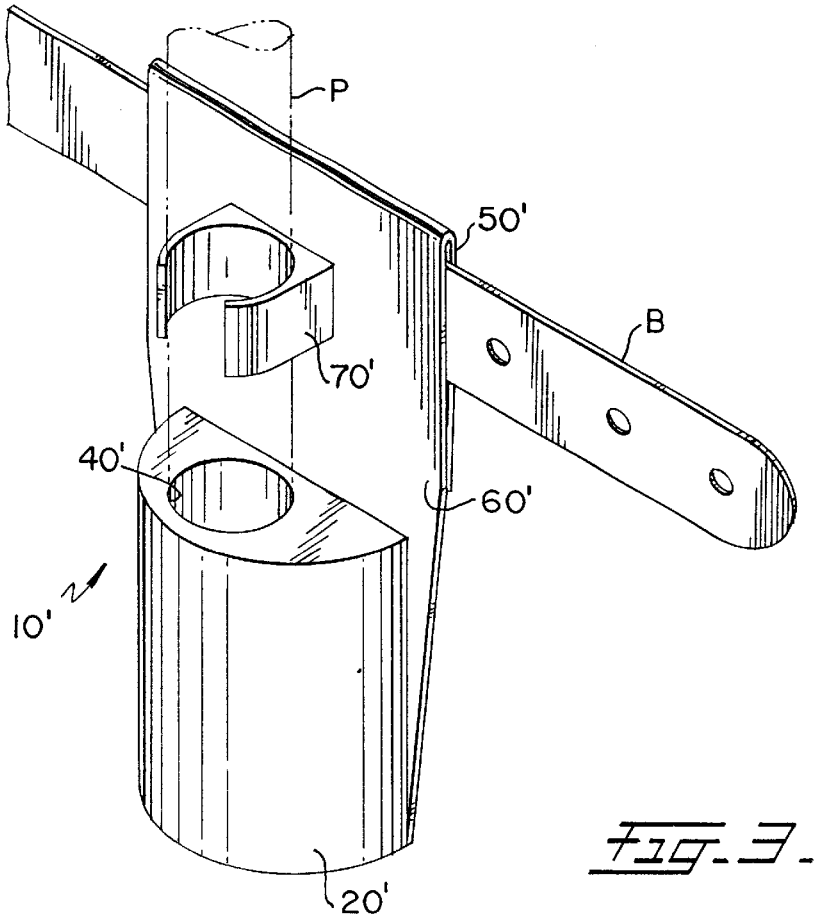
FIG. 3 is an isometric view of an alternate embodiment for this invention, having a marker pen holder mounted on a belt.
Figure 4A:
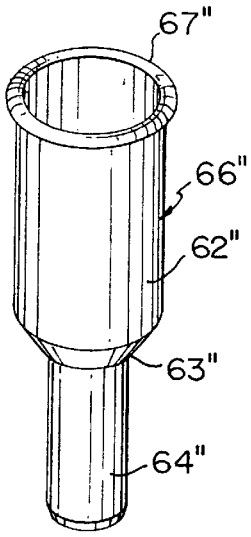
FIG. 4*a* elevational view of a removable holder member used with the alternate embodiment shown in FIG. 4.
Figure 4:
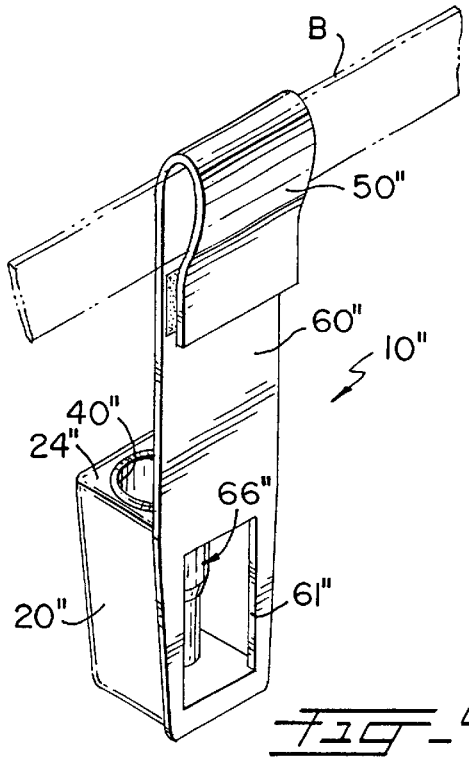
FIG. 4 is an isometric view of another alternate embodiment for the invention as shown in FIG. 3.

Alternate embodiments are shown in FIGS. 3 and 4 and being generally referred to with numerals 10' and 10". Cavities 40' and 40" are similar to cavities 40, in the stationary holder 10. The embodiment shown in FIG. 3 includes base member 60' with loop member 50' on one surface and the other surface has pen holder body 20' mounter thereon. Also, optional gripping member 70' is cooperatively positioned above opening 40' to secure pen P in place.

The embodiment shown in FIG. 4 and referred to with numeral 10" does not use a gripping member. Holder body 20" is mounted to one surface of base member 60". Opening 61" on base member 60" provides access to tubular pen holder member 66" which is removably mounted to opening 40". Member 66" has internal characteristics similar to upper and lower cavities 42 and 44 as well as slanted portion 43, and these are labeled 62", 64", and 63", respectively, in FIG. 4*a* for the respective outer out walls (the internal cross-section not being shown). Belt loop member 50" also functions like belt loop member 50'. Similarly, flange 67" has cooperative dimensions to rest on upper wall 24" suspending member 66" within holder body 20".

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A marker pen holder, comprising a marker pen, a housing body having a flat bottom and cylindrical opening including upper and lower cavities, said upper cavity having a diameter larger than the diameter of said lower cavity, and further including a slanted portion of said opening to make the transition from said upper cavity to said lower cavity with a smaller diameter than the diameter of said upper cavity and said slanted portion having cooperative dimensions to serve as a resting area for the tubular end of said marker pen that includes a tip that protrudes inside said lower cavity that substantially conforms to the shape and dimensions of said tip, so that said slanted portion and pen combination prevent the circulation of air to said lower cavity housing said tip.

2. The marker holder set forth in claim 1 wherein said housing body has a truncated shape with bottom and top walls, spaced apart from each other, and said cylindrical opening being substantially perpendicular to said top and bottom walls.

* * * * *